United States Patent [19]

Bailey

[11] Patent Number: 4,508,413

[45] Date of Patent: Apr. 2, 1985

[54] CONNECTOR

[75] Inventor: William R. Bailey, Villa Park, Ill.

[73] Assignee: Allied Corporation, Morris Township, Morris County, N.J.

[21] Appl. No.: 367,651

[22] Filed: Apr. 12, 1982

[51] Int. Cl.[3] ..... H01H 85/50; H01R 13/68

[52] U.S. Cl. ..... 339/129; 337/208; 337/228; 339/147 R

[58] Field of Search ..... 339/91 R, 147 R, 129, 339/61 R, DIG. 3; 337/201, 205, 208, 213, 214, 228, 235

[56] References Cited

U.S. PATENT DOCUMENTS

| | | | |
|---|---|---|---|
| 2,257,608 | 9/1941 | Keefe | 337/213 X |
| 2,813,174 | 11/1957 | Podell et al. | 337/201 X |
| 2,851,558 | 9/1958 | Linton | 337/214 X |
| 3,268,693 | 8/1966 | Linton | 337/201 X |
| 3,356,806 | 12/1967 | Urani | 337/205 X |
| 3,466,593 | 9/1969 | Arndt et al. | 339/DIG. 3 |
| 3,471,824 | 10/1969 | Gruelich et al. | 339/61 R |
| 3,685,006 | 8/1972 | Jerrold-Jones | 339/DIG. 3 |
| 3,936,787 | 2/1976 | Ranzanigo | 337/228 |

FOREIGN PATENT DOCUMENTS

| | | | |
|---|---|---|---|
| 582832 | 10/1958 | Italy | 337/214 |
| 7705772 | 6/1978 | Sweden | 337/228 |
| 0788222 | 12/1980 | U.S.S.R. | 337/228 |

*Primary Examiner*—Z. R. Bilinsky

*Attorney, Agent, or Firm*—Roger H. Criss

[57] ABSTRACT

Two embodiments of a panel mount fuseholder, a bayonet-lock type or a screw type, utilize numerous common components and are adaptable to receive a variety of fuse lengths. A common body member may be provided with a contact member of longer length to receive shorter fuses, and only an extension portion need be varied to accept a bayonet lock or screw lock cap member. A common cap member is provided with a joining member freely rotatably fastened thereto by a plurality of resilient fingers cooperating with a groove in the common cap member, and has an interior surface provided with either bayonet-lock means or a screw thread, for cooperating with corresponding means on the extension portion. The joining means of the invention and the general structure of the common cap member are also applicable to connectors in general.

7 Claims, 7 Drawing Figures

108
106
10a
16
28a
104
120
116
122
32
94
118
30
90
24
72
14
6
74
54
58
20
92
22
70
94
84
64
78
66
82
48
46
50
87
114
88
80
60
100
86
56
102
44
26
52
128
12
24
72
40
108
6
110
134
32
64
112
132
126
124

52
10b
108
106
28b
122
42
72
16
140
94
104
32a
142
30
74
14
118
90
24
42
70
70
92
58
20
94
22
70
84
64
78
66
82
48
46
87
132
50
88
128
80
60
86
54
100
102
44
114
26
110
134
124
52
108
112

CONNECTOR

This application is related to the field of electrical connectors. In particular, this application is related to panel mount fuseholders.

BACKGROUND OF THE INVENTION

Numerous kinds of fuseholders, particularly panel mount fuseholders, are known. Such fuseholders include an insulating body of a generally cylindrical or tubular shape for holding a fuse, a cap member for retaining the fuse, and contact members for establishing electrical contact with the end caps or ferrules of a fuse member within the fuseholder. Typically, the cap includes a generally tubular portion or fuse clip for making electrical contact with one ferrule or end cap of the fuse member, and for connecting the cap to the body. This tubular member is provided with external screw threads, cooperating with internal screw threads on a conductive socket member within the body, and connected to a suitable terminal, so that connections to both ends of the fuse member can be made on a single side of the panel. Such metallic tubular portions are also provided with bent-out tab portions, which cooperate with L-shaped slots or the like to establish a bayonet-lock type connection between the cap and the body. Since the use of bayonet-lock type fuseholders and screw-type fuseholders is a matter of the user's preference, it has heretofore been necessary to manufacture two different and incompatible fuseholders, with one or two minor compatible pieces, such as one terminal post and a retaining nut which retains a panel mount fuseholder to a panel. The nonconductive portion of the cap may be similar, but, since the differing tubular portions must be inserted at initial fabrication of the cap assembly, two entirely different cap assemblies must be produced.

The bayonet and screw-type connections conventionally used are metal-to-metal connections, which are inherently smooth, and with a low coefficient of friction. When no fuse is inserted, the fuse caps are apt to loosen and become separated from the remainder of the fuseholder. This is particularly true of the bayonet-lock type, since the force provided by a fuse pressing against a resilient spring in either the cap or the body is required to keep the mating portions of the bayonet lock correctly positioned.

Also, bayonet fuseholders of known types are designed in such a way that accidental depression of the cap may result in a momentary open circuit. In some applications, such as sequentially-operating equipment including numerically-controlled machine tools, such an accidental depression may result in damaged workpieces and a need to restart a task from the beginning.

The instant invention overcomes these and other disadvantages of the prior art.

SUMMARY OF THE INVENTION

In accordance with the invention, a panel mount fuseholder is provided with nonconductive elements for retaining the cap to the body, and conductive elements only for establishing electrical connection. It is an advantage of this arrangement that the resilience and high coefficient of friction of nonconductive materials such as plastics may be used to fasten the cap and body of a fuseholder. It is a feature of this arrangement that the cap and the body of the fuseholder are more firmly retained together when a fuse is not installed in the fuseholder.

It is a further object of the invention to produce a fuseholder which includes a maximum number of common components, minimizing the number of production steps, the number of tools and dies necessary to make fuseholders. It is an advantage of the invention that a less expensive and more dependable fuseholder can be produced. It is a primary feature of the invention that a common cap member may be provided with a freely rotatably mounted joining member, in either bayonet-lock or screw thread type, for cooperating with matching provisions on an extension portion of the fuseholder body, so that a single mold may be used to form the fuseholder body, with interchangeable mold portions for forming angled bayonet-lock grooves or screw threads on the extension portion of the body of the fuseholder.

It is a further object of the invention to provide a bayonet-type fuseholder where pressure applied to the cap will not result in interrupted electrical continuity. It is a feature of this invention that the means for retaining the cap is separate from the means for establishing electrical contact. It is an advantage of the invention that such a fuseholder may be installed in a location that is subject to frequent accidental contact.

These and other objects, features and advantages of the invention will become apparent from the description which follows.

BRIEF DESCRIPTION OF THE DRAWINGS

FIG. 5 is a sectional view of the first embodiment of the fuseholder shown in FIG. 1.

DESCRIPTION OF THE PREFERRED EMBODIMENTS

Figure 1:
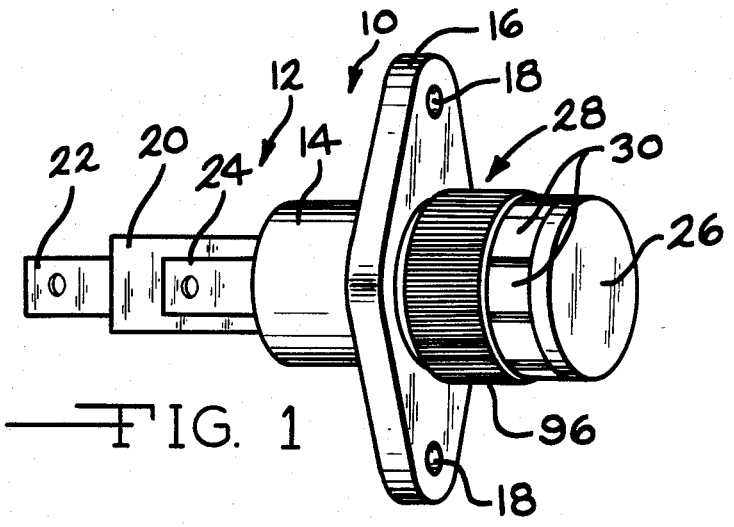
FIG. 1 is a perspective view of an assembled fuseholder according to the invention.

Referring initially to FIG. 1, there is shown a fuseholder 10, in perspective, illustrating the external appearance of either of the two preferred embodiments shown in the succeeding figures. Also, since the external appearance, as well as numerous component parts are identical between the two preferred embodiments, identical reference numerals for interchangeable components will be used.

Fuseholder 10 includes a body portion 12 shown as including an enlarged portion 14 and a flange portion 16. Flange portion 16 is shown as a diamond-shaped flange with mounting holes 18 provided for the passage of fasteners such as screws or rivets to mount fuseholder 10 to a mounting surface or panel. Body portion 12 has a first end 20, and includes provisions for making electrical connection to a fuse in fuseholder 10 protruding from body portion 12. A first connection portion 22 and a second connection portion 24 are electrically connected to opposing end caps or ferrules of a fuse member, as will be explained more fully below. Also, first end 20 of body portion 12 is, in the preferred embodiment, of a square or rectangular cross section, although any desired cross section, such as a cylindrical section may be used, if desired.

Figures 6, 7:
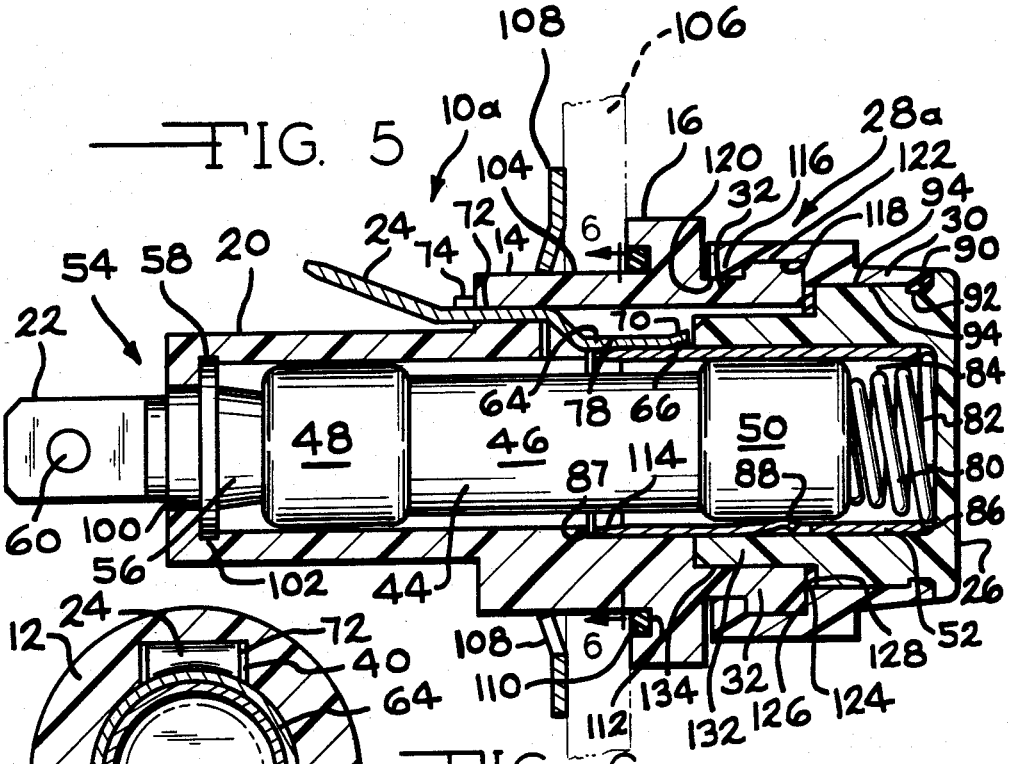
FIG. 6 is a sectional view taken along line 6—6 in FIG. 5.
FIG. 7 is a sectional view of a second embodiment of a fuseholder as shown in FIG. 1 according to the invention.

Fuseholder 10 also includes a cap portion 26 and a joining portion 28 for joining cap 26 and body 12, which is freely rotatably affixed to cap portion 12 by means of a plurality of mounting fingers 30 which snap into a groove as best shown in FIGS. 5 and 7.

Figure 2:
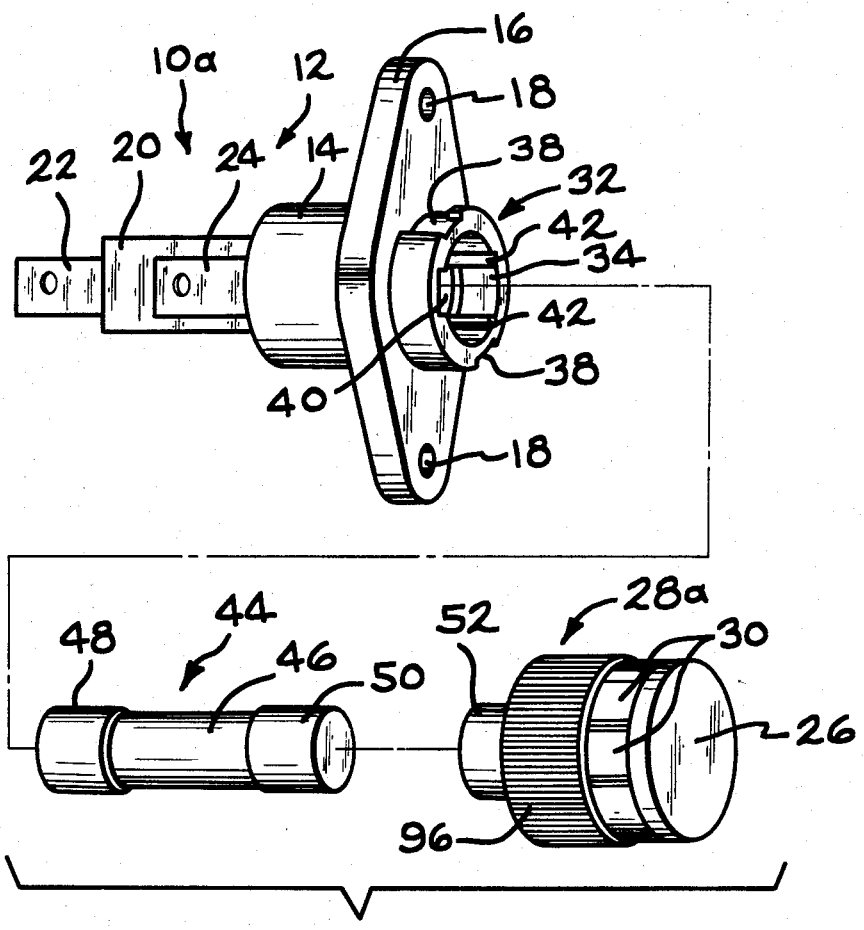
FIG. 2 is an exploded perspective view of a fuseholder according to a first embodiment of the invention, and a fuse.

Referring now to FIG. 2, a fuseholder 10*a* which has a bayonet-type interlock between the cap and body portions 26 and 12. As shown, body portion 12 includes an extension portion 32, which includes provisions for the bayonet interlock feature of fuseholder 10*a*.

At this point, it should be noted that the design of tools and dies necessary to manufacture such a fuseholder will be an obvious and routine matter to one skilled in the molding and manufacturing arts, and it will also be obvious that suitable molds can be easily made where the portion that molds extension portion 32 is removable, so that a mold portion for providing a screw interlock feature may be easily substituted. As shown, extension portion 32 surrounds entrance aperture 34, and defines, on its radial peripheral surface, a plurality of angled or L-shaped slots or grooves 38 appropriate for the female portion of a bayonet interlock. The interior surface of extension portion 32 also defines a first recess and a pair of second recesses 42. Recesses 40 and 42 are used to guide and support a second conductive contact portion of which second connection portion 24 is an integral part. Also shown in FIG. 2 is a fuse member 44 having a body portion 46, a first end cap or ferrule 48 and a second end cap or ferrule 50. As will be decribed in greater detail below, cap portion 26 includes a tubular member 52 forming a fuse clip for retaining end cap 50 of fuse 44 to facilitate the insertion and removal of fuses such as fuse 44 into a body portion 12.

Figures 3, 4:
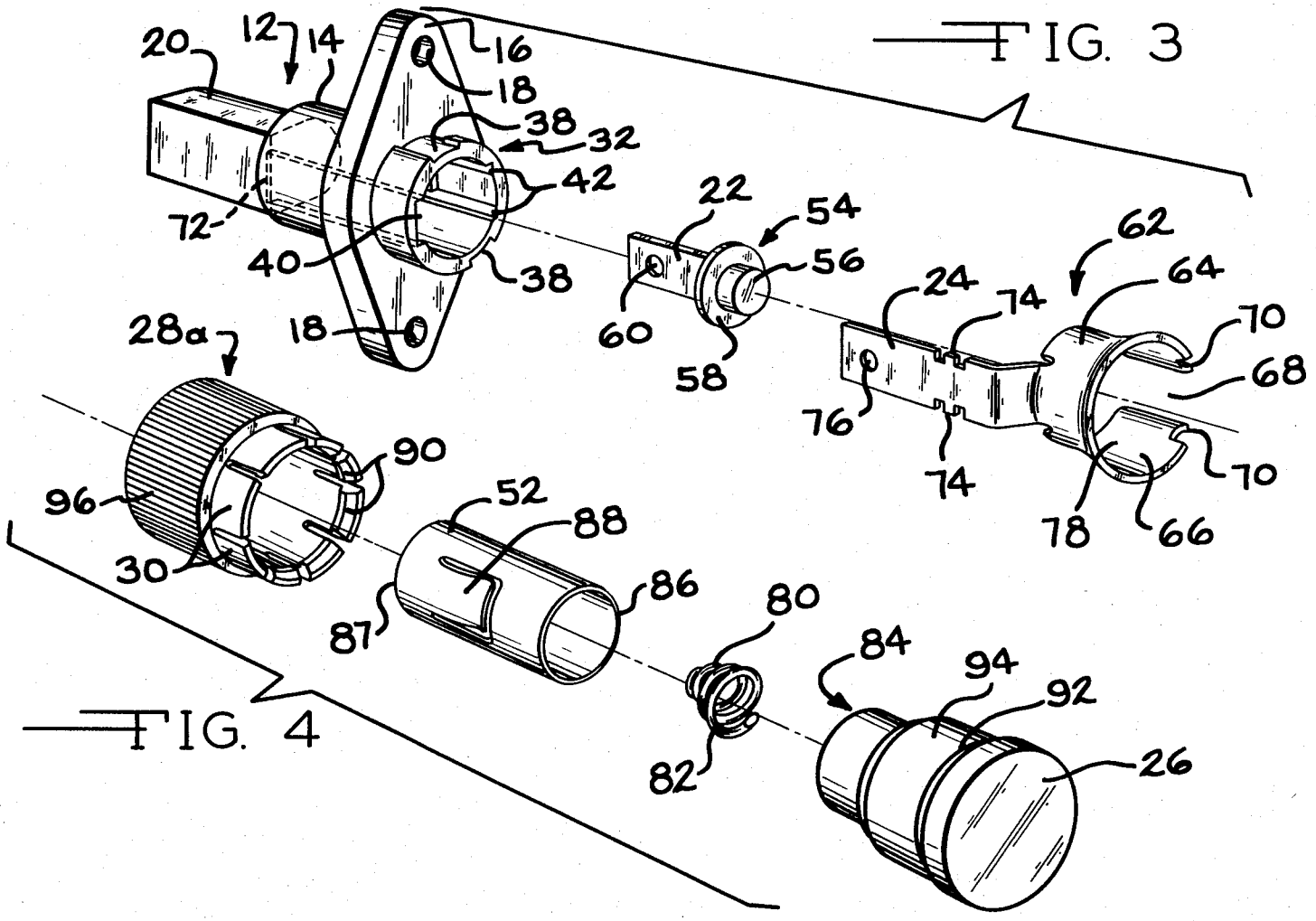
FIG. 3 is an exploded perspective view of the body portion of the fuseholder shown in FIG. 2.
FIG. 4 is an exploded perspective view of the fuseholder shown in FIG. 2.

Referring now to FIGS. 3 and 4, the fuseholder 10*a* shown in FIG. 2 is shown in an exploded view, with FIG. 3 being an exploded view of body portion 12, and FIG. 4 being an exploded view of cap portion 26 and joining portion 28*a*. A first conductive contact portion 54 includes first connection portion 22 and a fuse member contacting portion 56, and a retaining flange 58. First connection portion 22 is adapted to receive an electrical connection, such as by a screw, screw and nut, or screw and clamp assembly passed through hole 60, a wire soldered through hole 60, or, preferably, a conventional quick-connect female connector slipped over connection portion 22. Portion 56 provides a means for conveniently adjusting a fuseholder according to the invention to accept fuse members such as fuse member 44 of differing length. To adapt such a fuseholder to a shorter fuse, portion 56 is merely made longer to compensate for the shorter length of fuse within body portion 12. As is better shown in FIG. 5, first conductive contact portion 54 is inserted into body 12 while it is still hot and plastic after molding, retaining flange 58 forming a retaining groove in an interior surface of body portion 12. A second conductive contact portion 62, of which second connection portion 24 is an integral part, is inserted later. As shown, second conductive contact portion 62 includes a generally ring-shaped portion 64, provided with a diverging entrance section 66, and interrupted to form a gap 68. Portion 64 is also provided with locating tabs 70 which cooperate with grooves 44. At assembly, second conductive contact portion is inserted in body 12 such that second connection portion 24 engages first recess 40, and tabs 70 in gauge second recesses 42, and second connection portion 24 is pushed through aperture 72. When second conductive contact portion 62 is fully seated within body portion 12, tabs 74 of second connection portion 24 protruding through aperture 72 are bent to prevent second conductive contact portion 64 from being withdrawn. As with first connection portion 22, second connection portion 24 is also adapted to receive an electrical connection, such as by a screw, screw and nut or screw and clamp assembly passed through hole 76, a wire soldered through hole 76, or a conventional female quick-connector slipped over second connection portion 24. The diameter of inner surface 78 of generally ring-shaped portion 64 is chosen to closely receive tubular member 52, for establishing electrical contact between second connector portion 24 and tubular member 52.

Referring now to FIG. 4, there are shown the individual components of a cap assembly in accordance with the invention, in an exploded view. This figure also illustrates the method of assembly of a cap assembly according to the invention. A resilient means for urging a fuse against first conductive contact portion 54 when the fuseholder is assembled is shown as a conical helical spring 80 having an outermost coil 82. As is better shown in FIGS. 5 and 7, spring 80 is inserted into an axial bore 84 in cap portion 26, preferably at a time when cap portion 26 is still warm and somewhat plastic after molding, and retained by contact of edge 86 of tubular member 52 against outermost coil 82. Tubular member 52 is preferably inserted into axial bore 84 immediately following the insertion of spring 80. Tubular member 52 is provided with an indented portion 88, defined by a generally U-shaped slit in tubular member 52. This indented portion 88 serves to frictionally retain an end cap or ferrule of a fuse, such as end cap 50 of fuse member 44, to facilitate its insertion and removal from the fuseholder.

In manufacturing the illustrated embodiment of the invention, joining portion 28*a* is then freely rotatably mounted on cap portion 26 by positioning joining member 28*a* so that latching portions 90 of mounting fingers 30 engage groove 92 defined by surface 94 of cap portion 26. As illustrated, joining portion 28*a* has a knurled or serrated area shown as area 96, to facilitate its manual rotation with respect to cap portion 26.

At this point, it should be specifically noted that certain features of the disclosed fuseholder are usable in any type of electrical connector. In particular, the freely rotatable mounting of a joining portion for fastening a cap portion in place by providing the joining portion with a plurality of resilient mounting fingers such as fingers 30 and latching portions such as portions 90 for cooperating with a groove such as groove 92 in a cap such as cap portion 26. Obviously, in such an application, spring 80 and tubular member 52 may be omitted, and an axial bore such as axial bore 84 could be made to extend throughout the body of a cap member such as cap member 26, which would be an obvious modification of this feature of the invention for use, with other conventional components, as a connector in itself. In other words, this disclosed feature of the invention is usable with any first body defined by a surface of revolution, such as cap member 26, including an axial bore extending at least partly through the first body, such as axial bore 84, with an annular body such as joining portion 28*a* adapted to join the first body upon which it is mounted to a second body, which is freely rotatably mounted to the first body by means of a plurality of resilient mounting fingers each including a generally-perpendicular latching portion, such as fingers 30 and portions 90, which cooperate with an annular groove such as groove 92 in an outer surface such as surface 94 of a first body such as cap member 26.

Referring now to FIG. 5, a detailed sectional view of the first embodiment of the invention, it can be seen that first conductive contact portion 54 is inserted through entrance aperture 34 to first end 20 of body portion 12 while it is still somewhat plastic after molding, so that first connection portion 22 passes through aperture 100, and so that retaining flange 58 forms a retaining groove 102 adjacent first end 20. Fuseholder 10*a* is shown installed through an aperture 104 in a panel 106, and retained either by fasteners passing through mounting holes 18, or, if a suitable shape for flange 16 for mounting holes 18 is not desired, by a retaining means shown as a retaining washer 108 similar in shape to an internal-tooth lock washer applied to enlarged portion 14 adjacent panel 106. An O-ring 110 is shown placed in a groove 112 in flange portion 16 adjacent panel 106, for forming a waterproof seal between flange portion 16 and panel 106.

Also, as shown in detail, edge 86 of tubular member 52 has a tapered area 114 for insertion within inner surface 78 of generally ring-shaped portion 64, to make electrical connection between tubular member 52 and second connector portion 24. Cap portion 26, with tubular member 52, is retained to and fastened to body portion 12 by a bayonet-lock fastening formed by inwardly-directed protrusions 116 from interior surface 118, cooperating with angled slots formed in exterior surface 122 of extension portion 32, forming a bayonet lock between cap 26 and body portion 12. As also can be seen, joining portion 28*a* is freely rotatably mounted to cap 26 by means of latching portions 90 of mounting fingers 30 engaging groove 92. An O-ring 124, for forming a waterproof seal between cap 26 and extension portion 32 of body portion 12 is shown interposed between end surface 126 of extension portion 32 and stepped portion 128 between surface 94 and a surface 130 of cap portion 26. As shown, surface 130 defines the outer diameter of a pilot portion 132 of cap portion 26 which is received within an inner surface 134 of extension portion 32.

FIG. 6 is a sectional view taken along line 6—6 in FIG. 5, and shows tubular member 52 received within generally ring-shaped portion 64, with locating tabs 70 disposed in second recesses 42, and second connection portion 24 disposed in first recess 40.

FIG. 7 shows a fuseholder 10*b*, which is similar in all respects other than the configuration of a joining portion 28*b* and an extension portion 32*a*, so that otherwise-identical manufacturing and assembly procedures apply. Identical reference numerals are used for identical parts. As can be seen, the only significant difference between FIG. 5 and FIG. 7 is that a screw-type interlock rather than a bayonet-type interlock is provided between cap portion 26 and body portion 12. As shown in FIG. 7, joining portion 28*b* includes a screw thread 140 formed or defined in interior surface 118 of joining member 28*b*, which cooperates with a screw thread 142 formed in exterior surface 122. Screw threads 140 and 142 are of identical pitch diameters and lead, and are preferably multiple-entry screw threads, so that less than a full turn of joining portion 28*b* is necessary to engage threads 140 and 142.

Thus, in either the first or second disclosed embodiments of the invention, a connection is made to a fuse such as fuse 44, current flowing, for example, from first connection portion 22 to fuse member contacting portion 56, to first end cap 48, through fuse 44 to second end cap 50, and then primarily through conical helical spring 80 to tubular member 52. Tubular member 52 is in electrical contact with generally ring-shaped portion 64, so that current flows into generally ring-shaped portion 64, and then to second connection portion 24, completing an electrical circuit between connection portions 22 and 24.

In addition to the multiple uses of the novel features of cap 26 and joining portions 28*a* or 28*b*, it will be apparent to one skilled in the art that numerous modifications and variations of the disclosed embodiments of the invention may be easily made, without departing from the spirit and scope of the invention.

I claim:

1. A fuseholder, comprising:

a body portion, said body portion being adapted to contain at least a portion of a generally cylindrical fuse member, said fuse member having a body portion and first and second end cap portions at opposite ends thereof;

said body portion including at a first end thereof a contact member adapted to contact said first end cap portion of said fuse member, said contact member extending the exterior of said first end of said body portion and including a connection portion adapted to receive an electrical connection thereto;

a cap portion for retaining said fuse member in said fuseholder, said cap portion including means for retaining said second end cap portion of said fuse member and resilient means adapted to contact said second end cap portion to urge said fuse member towards said contact member when said cap portion is joined to said body portion said means for retaining said second end cap portion being a tubular member protruding from an end thereof and adapted to be inserted into said body portion;

said body portion including a second contact portion adapted to frictionally received said tubular member and to establish electrical connection thereto, said second contact postion including a generally ring-shaped portion adapted to receive said tubular portion and a second connection portion extending to the exterior of said body portion and adapted to receive an electrical connection thereto;

said cap member having a joining member for joining said cap portion to said body portion, said joining portion being freely rotatably mounted to said cap member;

said joining member being freely rotatably mounted to said cap member by a plurality of resilient mounting fingers integral with said joining member and adapted to cooperate with a circumferential groove of said cap member, said cap member defining said groove in an outer surface thereof;

said body portion including means adapted to cooperate with said joining member for joining said cap portion to said body portion, and establishing an electrical current path from said second end cap portion through said tubular member and said resilient means to said generally ring-shaped portion and said second connection portion.

2. A fuseholder according to claim 1, wherein:

said joining member includes an interior surface defining a plurality of inwardly-directed protrusions therefrom, and said means adapted to cooperate with said joining member is a plurality of angled slots formed on an exterior surface of said body portion adapted to cooperate with said plurality of fingers for providing a bayonet-lock fastening between said cap portion and said body portion.

3. A fuseholder according to claim 1, wherein:

said joining member includes a screw thread formed on an interior surface thereof, and said means adapted to cooperate with said joining member is a screw thread formed on an exterior surface of said body portion for providing a screw fastening between said cap portion and said body portion.

4. A fuseholder according to claim 2 or 3, wherein:

said body portion further including a mounting portion adapted to cooperate with a panel means to retain said fuseholder to said panel in an opening therethrough.

5. A fuseholder, comprising:

a nonconductive body portion;

a first conductive contact portion;

a second conductive contact portion;

a nonconductive cap portion; and a nonconductive joining portion;

said first contact portion being provided at a first end of said body portion for establishing electrical connection to a first end cap portion of a fuse member disposed in said body portion, and including a first connection means, said first contact portion passing through an end wall of said body portion;

said body portion including an enlarged portion adapated to be passed through an aperture in a mounting panel for mounting said fuseholder to said panel and includes a flange portion adapted to engage a first surface of said panel;

said body portion further including an extension portion, said extension portion being provided with joining means adapted to retain said joining portion thereto;

said body portion defining an entrance aperture adapted to receive said fuse member therethrough and a first aperture adapted to receive a connection portion of said second contact portion therethrough, said connection portion extending therethrough, said second contact portion further including a generally ring-shaped portion disposed adjacent said entrance aperture in a fuse-receiving chamber defined by said body portion of said fuseholder;

said cap portion defining an axial aperture therein;

a conical helical spring being disposed in said axial aperture at a closed end thereof and retained in said axial aperture by a tubular member, said tubular member being adapted to receive a second end cap portion of said fuse member, said tubular member extending substantially beyond said axial aperture and being adapted to be closely received in said generally ring-shaped portion of said second contact portion when said cap portion is disposed adjacent said body portion;

said joining portion being freely rotatably mounted to said cap portion;

said joining member being freely rotatably mounted to said cap member by a plurality of resilient mounting fingers integral with said joining member and adapted to cooperate with a circumferential groove of said cap member, said cap member defining said groove in an outer surface thereof;

said joining portion being adapted to cooperate with said joining means of said extension portion to fasten said cap portion adjacent said body portion and retain said fuse in said fuseholder;

whereby only nonconductive portions of said fuseholder mechanically fasten said cap portion to said body portion.

6. A fuseholder according to claim 5, wherein:

said joining portion includes an interior surface defining a plurality of inwardly-directed protrusions therefrom, and said joining means of said extension portion is a plurality of angled slots adapted to cooperate with said fingers for providing a bayonet-lock fastening between said cap portion and said body portion.

7. A fuseholder according to claim 5, wherein:

said joining portion includes a screw thread formed on an interior portion thereof, and said joining means of said extension portion includes a screw thread for providing a screw fastening between said cap portion and said body portion.

* * * * *